US012727640B2

(12) United States Patent
Hillyer et al.

(10) Patent No.: US 12,727,640 B2
(45) Date of Patent: Sep. 8, 2026

(54) FOOTWEAR INCLUDING A SOLE WITH A BOTTOM SUPPORT MEMBER

(71) Applicant: DECKERS OUTDOOR CORPORATION, Goleta, CA (US)

(72) Inventors: Christopher Hillyer, Goleta, CA (US); Jean-Luc Diard, Annecy (FR); Stephen Kass, Carpinteria, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 0 days.

(21) Appl. No.: 18/180,562

(22) Filed: Mar. 8, 2023

(65) Prior Publication Data

US 2023/0284739 A1 Sep. 14, 2023

Related U.S. Application Data

(60) Provisional application No. 63/269,103, filed on Mar. 9, 2022.

(51) Int. Cl.
*A43B 13/02* (2022.01)
*A43B 13/12* (2006.01)

(52) U.S. Cl.
CPC ..... *A43B 13/026* (2013.01); *A43B 13/125* (2013.01)

(58) Field of Classification Search
USPC ..... 36/25 R
See application file for complete search history.

(56) References Cited

U.S. PATENT DOCUMENTS

| | | | | |
|---|---|---|---|---|
| 4,186,500 | A * | 2/1980 | Salzman | A43B 5/0411 280/615 |
| 5,784,808 | A * | 7/1998 | Hockerson | A43B 13/181 36/102 |
| 6,675,497 | B2 * | 1/2004 | Sedlbauer | A43B 7/12 36/4 |
| 6,782,639 | B1 * | 8/2004 | Muller | A43B 13/145 36/117.4 |
| 8,381,416 | B2 | 2/2013 | Geer et al. | |
| 8,567,094 | B2 | 10/2013 | Lubart | |
| 8,578,633 | B2 | 11/2013 | Roether et al. | |
| 11,051,582 | B2 | 7/2021 | Case et al. | |
| 2002/0178621 | A1 * | 12/2002 | Darby | A43B 7/147 36/110 |
| 2006/0143942 | A1 * | 7/2006 | Lebo | A43B 13/383 36/25 R |
| 2006/0143950 | A1 * | 7/2006 | Beak | A43B 13/04 36/97 |
| 2006/0265902 | A1 * | 11/2006 | Kita | A43B 13/183 36/12 |
| 2007/0119076 | A1 * | 5/2007 | Brewer | A43B 7/06 36/28 |

(Continued)

OTHER PUBLICATIONS

PCT Search Report and Written Opinion for corresponding PCT Application No. PCT/US2023/063982 dated Jul. 18, 2023 (8 pages).

(Continued)

*Primary Examiner* — Matthew R Marchewka
(74) *Attorney, Agent, or Firm* — Greer, Burns & Crain Ltd.

(57) ABSTRACT

An article of footwear includes a sole including a midsole and an outsole attached to the midsole, and a support member positioned on a bottom surface of the midsole, where the support member has a curved surface that extends from a rear end to a front end of the support member.

20 Claims, 7 Drawing Sheets

(56) References Cited

U.S. PATENT DOCUMENTS

| | | | | |
|---|---|---|---|---|
| 2007/0169379 | A1* | 7/2007 | Hazenberg | A43B 13/141 36/102 |
| 2008/0229617 | A1* | 9/2008 | Johnson | A43B 3/0057 36/102 |
| 2008/0263900 | A1* | 10/2008 | Determe | A61F 5/0195 36/110 |
| 2009/0172971 | A1* | 7/2009 | Peikert | A43B 13/12 12/146 B |
| 2009/0293308 | A1* | 12/2009 | Bruce | A43B 13/143 36/34 R |
| 2010/0024255 | A1 | 2/2010 | Oumnia | |
| 2011/0185590 | A1* | 8/2011 | Nishiwaki | A43B 13/187 36/28 |
| 2016/0037857 | A1* | 2/2016 | Foxen | A43B 7/1405 36/103 |
| 2017/0095033 | A1* | 4/2017 | Farina | A43B 7/18 |
| 2018/0255868 | A1* | 9/2018 | Cole | A43B 13/42 |
| 2020/0245717 | A1* | 8/2020 | Fusco | A43B 13/026 |
| 2022/0039506 | A1* | 2/2022 | Diard | A43B 3/0042 |
| 2023/0284740 | A1* | 9/2023 | Ikura | A43B 13/125 |

OTHER PUBLICATIONS

PCT Patent Application PCT/US2023/063982: International Preliminary Report on Patentability, Sep. 19, 2024 (7 pages).

* cited by examiner

FOOTWEAR INCLUDING A SOLE WITH A BOTTOM SUPPORT MEMBER

CROSS-REFERENCE TO RELATED APPLICATIONS

This application is a non-provisional application of and claims priority to U.S. Provisional Patent Application No. 63/269,103 filed on Mar. 9, 2022, the entire contents of which is incorporated herein by reference.

BACKGROUND

The present application relates generally to footwear, and more particularly, to a sole having a curved surface that extends the length of the sole to promote a natural rolling motion of a user's foot to help efficiently transition from their heel to their forefoot while walking, jogging and running and lessen impact stresses on the user's body.

While walking, jogging or running, it is important to maintain stability, balance and control. It is also important for a person's feet to be sufficiently supported and cushioned as they encounter different impact stresses. Walking, jogging and running also involves the transfer of energy between a person's legs and feet and an underlying surface, such as the ground, contributing to propelling a person forward along a trail, a sidewalk, a street or other path. The power a person is able to produce and the speed at which a person is able to move in a forward direction depends on a number of factors. For example, the ability to properly apply forces on a surface affects the energy produced and the rate of speed that the person is able to move. If a person's feet are not sufficiently supported by their shoes and their feet to do not have a stable push off point, less energy could be transferred from the person's feet to the ground to move the person forward. Also, the efficient transition from the heel to the forefoot enhances forward movement.

It is therefore desirable to provide footwear that enables a person's feet to efficiently transition from their heel to their forefoot and supports and cushions a person's feet during movement to lessen the effect of impact stresses while efficiently using the person's energy to move them forward.

SUMMARY

The present article of footwear has a sole having a curved surface extending from a rear end to a front end of the sole to enable a user's foot to naturally roll during movement to help reduce stresses on the user's body while promoting an efficient transfer of energy and movement in a forward direction.

In an embodiment, an article of footwear is provided and includes a sole including a midsole and an outsole attached to the midsole, and a support member positioned on a bottom surface of the midsole, where the support member has a curved surface that extends from a rear end to a front end of the support member.

In another embodiment, an article of footwear is provided and includes a sole having a midsole and an outsole attached to the midsole, and a support plate positioned between the midsole and the outsole, where the support member and the outsole each have a curved surface that extends from a rear end to a front end of the support member.

DETAILED DESCRIPTION

The present invention is directed to an article of footwear or shoe having a sole with a curved surface at or near a bottom surface of the sole to facilitate a natural rolling motion of a user's foot by enabling the user to efficiently transition from their heel to their forefoot during movement, such as walking, jogging or running, while providing sufficient cushioning to dampen impact forces on the user's body.

Figure 1:
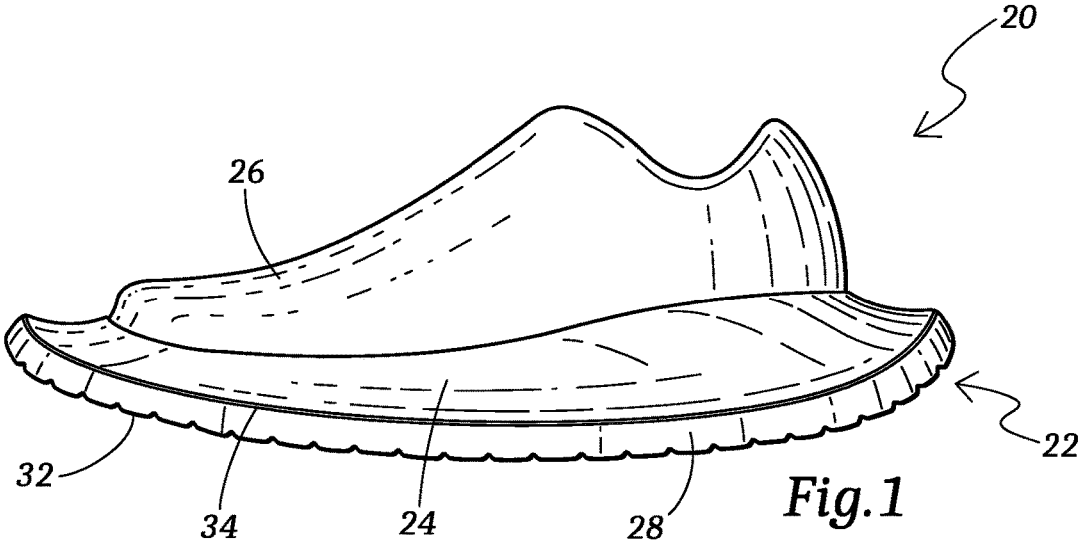
FIG. 1 is a side view of an embodiment of a shoe including the present sole.
Figure 2:
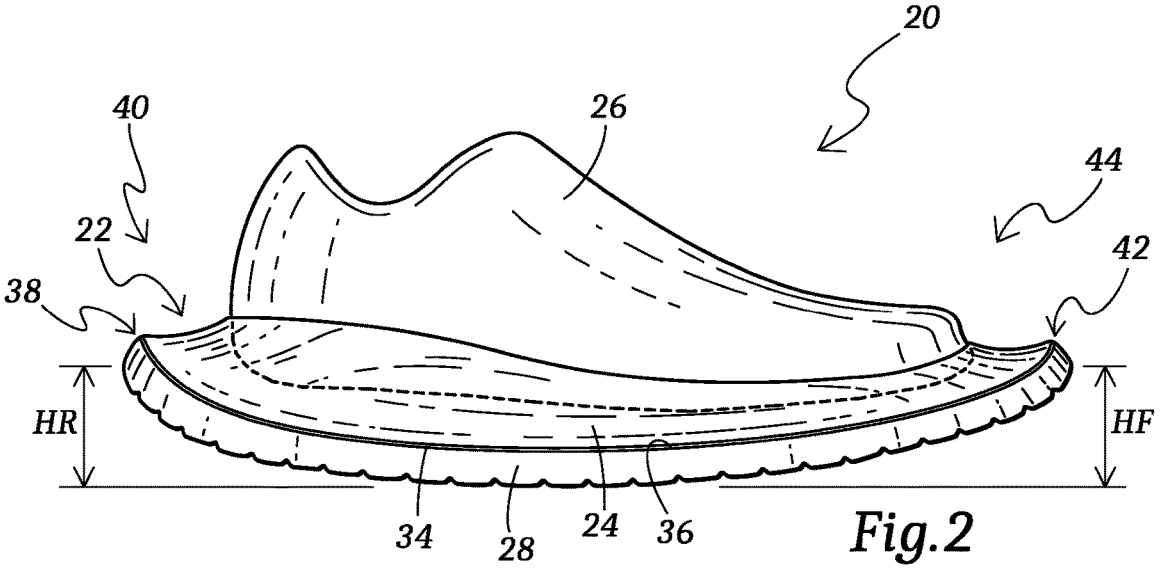
FIG. 2 is a schematic view of the sole of FIG. 1.
Figure 3:
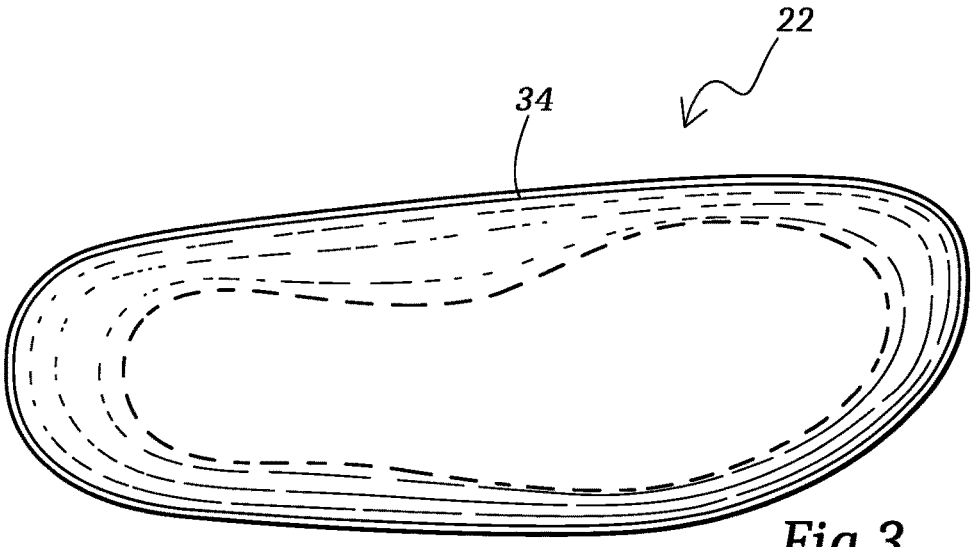
FIG. 3 is a top view of the support plate of the sole of FIG. 1.

Referring now to FIGS. 1-3, an article of footwear or shoe 20 includes an embodiment of the present sole, generally indicated as 22, where the sole 22 includes a midsole 24 attached to an upper 26, and an outsole 28. The midsole 24 may be an integral, molded component made of a material having a designated hardness value or made with different materials having the same or different hardness values. For example, one or more portions of the midsole 24 may be made with a material having a hardness or hardness value that is greater than a hardness or hardness value in other areas of the midsole to increase the stability and support or cushioning in designated areas of the midsole. As shown in FIG. 1, the outsole 28 is attached to a bottom surface 30 of the midsole 24 by an adhesive or by molding, and is made of rubber. The outsole 28 typically includes a plurality of tread members 32 that are configured to grip an underlying surface, such as the ground, during movement. It should be appreciated that the midsole 24 and outsole 28 may be made of a foam material, rubber, ethylene vinyl acetate (EVA), thermoplastic polyurethane (TPU), a composite material or any suitable material or combination of materials. any suitable materials or combinations of materials.

In another embodiment shown in FIGS. 2 and 3, the sole 22 includes a support member, such as a support plate 34, that is positioned between the midsole 24 and the outsole 28 and extends along an entire width and length of the midsole and outsole. More specifically, the support plate 34 has a shape and size that is the same as the shape and size of the bottom surface 30 of the midsole and the top surface 36 of the outsole 28. In this embodiment, the support plate 34 is made of a carbon-reinforced material. It should be appreciated that the support plate 34 may be made out of ethylene vinyl acetate (EVA), rubber or any suitable material or combination of materials. Further, the support plate 34 has a thickness of 0.5 mm to 2.0 mm but may have any suitable thickness. In the illustrated embodiment, the support plate 34 has a uniform thickness along the length of the support plate. In another embodiment, the thickness of the support plate 34 may be different in different areas of the support plate. For example, a thickness of the support plate 34 in the heel area may be greater than a thickness of the support plate in the forefoot area.

As shown in FIG. 2, the support plate 34 and the outsole 28 each extend from a rear point 38 at a rear end 40 of the sole 22 to a front point 42 at a front end 44 of the sole. In the illustrated embodiment, the support plate 34 and the outsole 28 both have a concave curved shape that extends from the rear point 38 to the front point 42 where a height HF of the front point 42 of the sole 22, i.e., the distance between the front point 42 and the underlying surface, is greater than a height HR of the rear point 38 of the sole 22. It should be appreciated that in other embodiments, HF and HR may be the same or HR may be greater than HF.

Figure 4A:
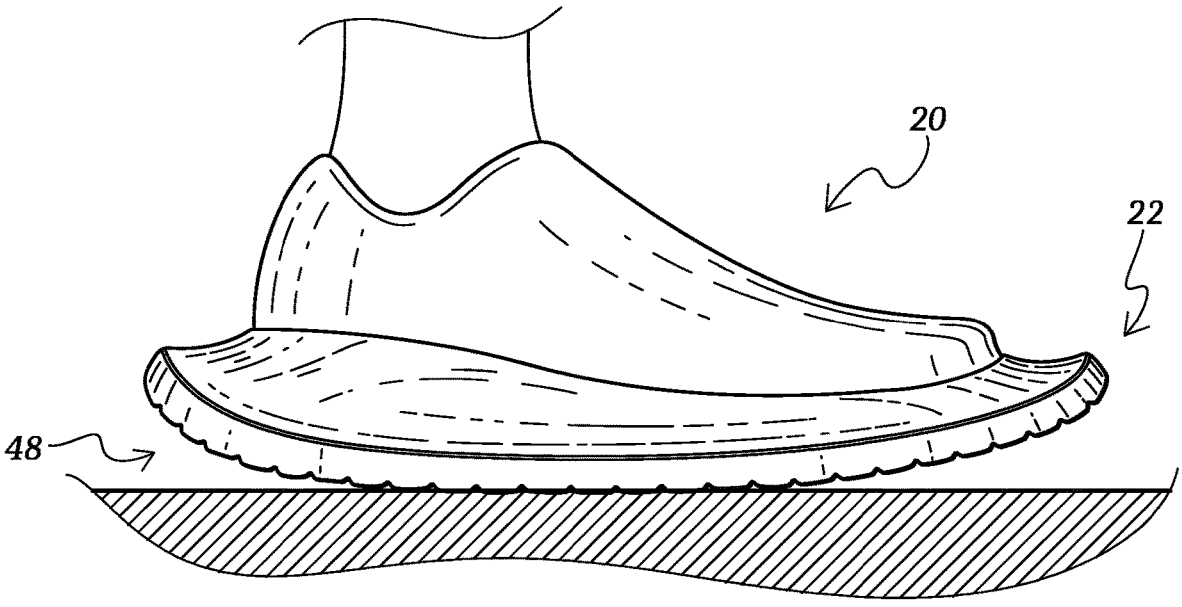
FIG. 4A is a perspective view of the sole of FIG. 1, where the heel area of the shoe is impacting the ground.
Figure 4B:
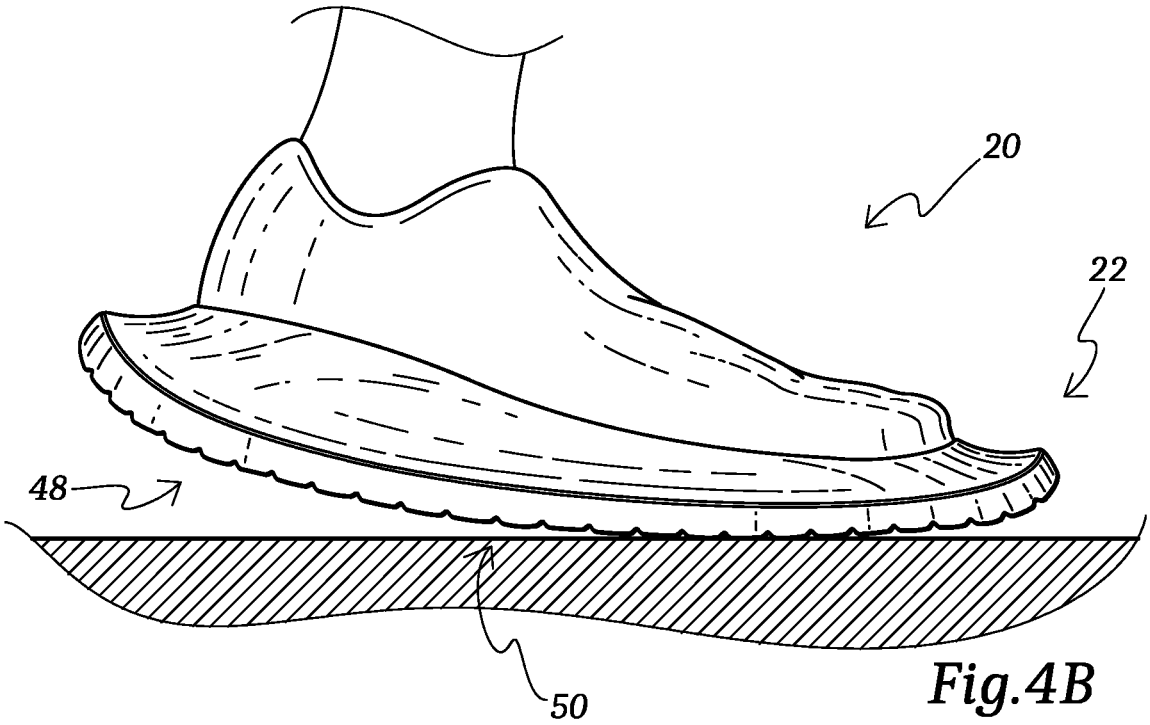
FIG. 4B is a side perspective view of the shoe of FIG. 1, where the midfoot area of the shoe is impacting the ground.
Figure 4C:
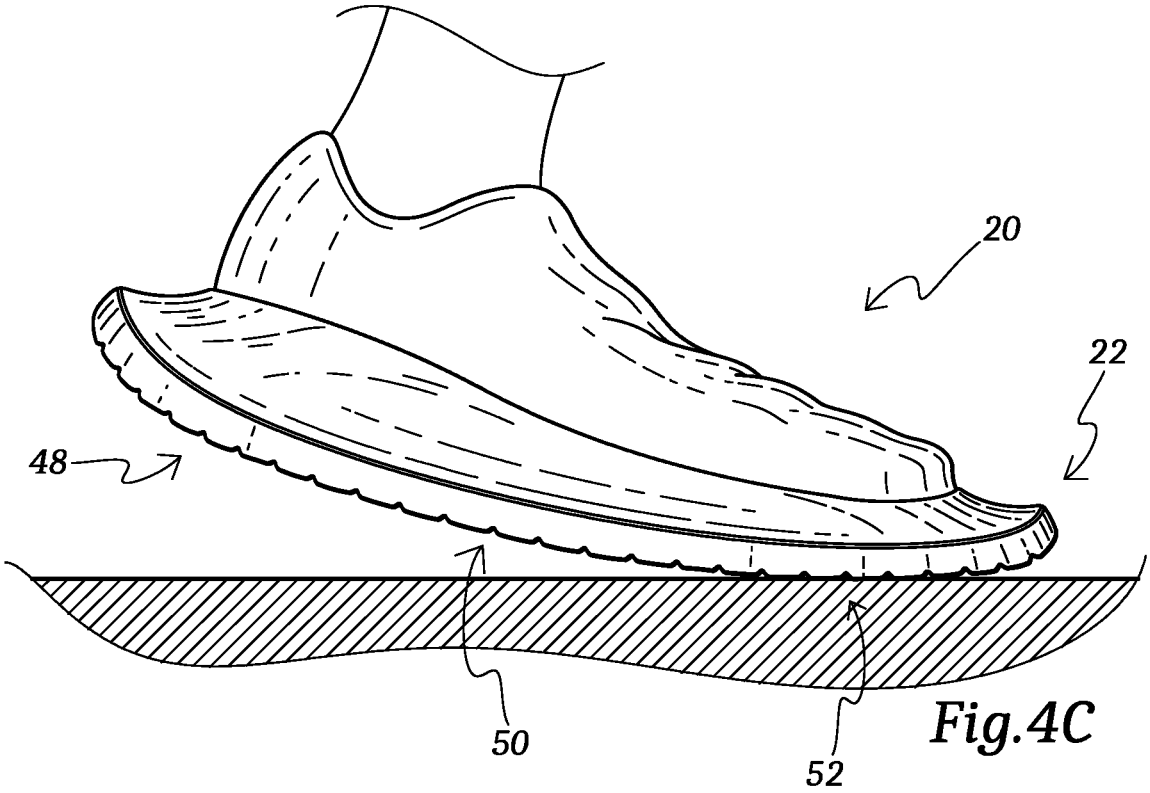
FIG. 4C is a side perspective view of the shoe of FIG. 1, where the forefoot area of the shoe is impacting the ground.

Placing the curved support plate 34 between the midsole 24 and the outsole 28 so that the support plate is closer to the bottom surface of the shoe 20 facilitates a natural rolling motion of the user's foot while wearing the shoe during movement, which helps to reduce impact stresses on a user's body and move the user's foot forward while enhancing the efficient transition from the heel to the forefoot of the user's foot. The support plate also enables the thickness of the sole, and more specifically, the midsole to be reduced from thicknesses of conventional soles as the support plate provides the underlying support to a user's foot typically provided by the sole. FIGS. 4A to 4C illustrate an example of the rolling motion of the shoe 20 during movement, such as during jogging or running. In FIG. 4A, the rear area of the sole 22, and more specifically, the heel area 48 of the sole initially impacts the ground during movement. The curvature of the sole with the support plate and the position of the support plate 34 on the bottom surface of the midsole helps to cause the user's foot to roll onto their midfoot as shown in FIG. 4B wherein the midfoot area 50 of the sole is contacting the ground. The rolling motion associated with the support plate 34 then causes the user's foot to roll onto their forefoot as shown FIG. 4C where the forefoot area 52 of the sole 22 is contacting the ground. In this way, the user's foot rolls from their heel to their forefoot in a fluid motion that helps to promote the natural gait of the user and reduce impact stresses on the user's body during movement. In this embodiment, the curvature or roundness of the support plate 34 and/or the outsole 28 may be adjusted to accommodate different gaits, running styles, foot impact positions and impact stresses for different types of runners. For example, the curvature of the support plate 34 may be adjusted to accommodate runners that supinate or pronate during jogging or running.

In this embodiment, the support plate 34 is preferably made of a reinforced material. In another embodiment, the support plate 34 is made of a rigid foam material having a radius of curvature that promotes the rolling motion of the user's foot during movement. In a further embodiment, a rigid material such as a rigid foam or EVA is injected between the midsole 24 and outsole 28 or placed between the midsole 24 and outsole 28 and pressed together to form the sole 22. It should be appreciated that the support plate 34 may be made of a reinforced material, a carbon-fiber reinforced material, a foam material, EVA, TPU, a metal material, a composite material or any suitable material or combination of materials.

Referring now to FIGS. 5 to 8, additional embodiments of the support plate are illustrated where the support plate has different shapes and configurations.

Figure 5:
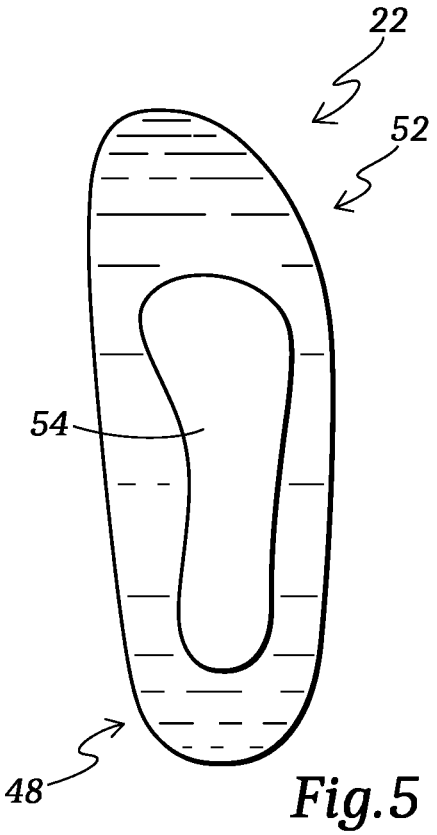
FIG. 5 is a top view of the sole including an embodiment of the support plate.

In FIG. 5, an embodiment of the support plate is shown where the support plate 54 extends from the heel area 48 to partially into the forefoot area 52 of the sole 22. The support plate 54 also has a width that is less than a width of the sole 22 where the width of the support plate varies along the length of the support plate. In this embodiment, the support plate 54 is curved and has uniform thickness, where the thickness may also vary along the length of the support plate.

Figure 6:
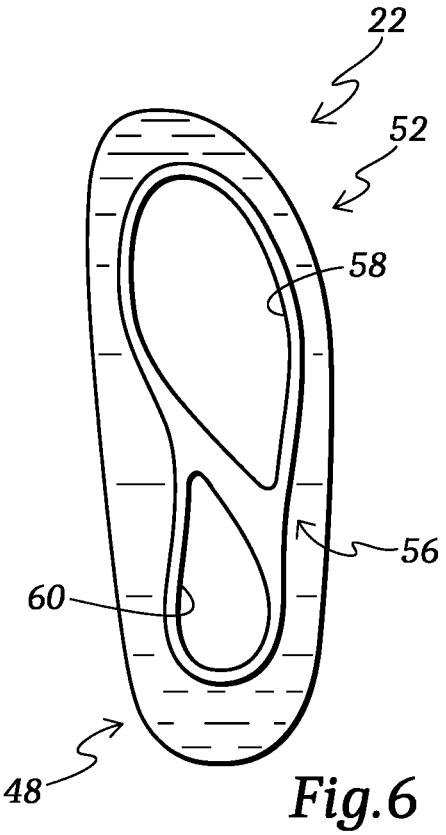
FIG. 6 is a top view of the sole including another embodiment of the support plate.

In FIG. 6, another embodiment of the support plate is shown where the support plate 56 extends from the heel area 48 to the forefoot area 52 of the sole 22. Similar to the embodiment in FIG. 5, the width of the support plate 56 is less than a width of the sole 22 and varies along the length of the support plate. In this embodiment, the support plate 56 has a front through-hole 58 and a rear through-hole 60, which reduces the weight of the support plate 56, and thereby reduces the weight of the sole 22 on the overall weight of the shoe, while providing the support and rolling motion described above. It should be appreciated that the front through-hole and the rear through-hole may be any suitable shape and size.

Figure 7:
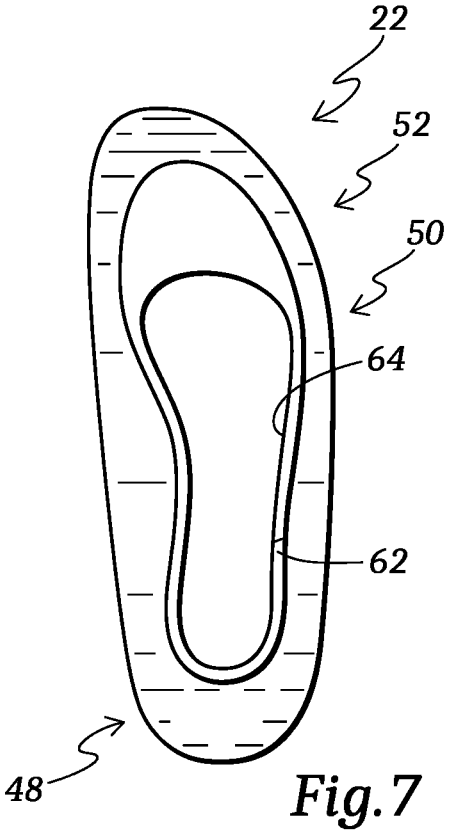
FIG. 7 is a top view of the sole including a further embodiment of the support plate.

In FIG. 7, a further embodiment of the support plate is shown where the support plate 62 extends from the heel area 48 to the forefoot area 52 of the sole 22 and has a width that is less than the width of the sole and varies along the length of the sole. In this embodiment, the support plate 62 includes a through-hole 64 located primarily in the midfoot area 50 and the heel area 48 of the sole. This configuration of the support plate 62 concentrates most of the rigidity and support of the support plate in the forefoot area 52 to enhance propulsion of the user's foot during movement. It should be appreciated that the through-hole 64 may be any suitable shape and size to accommodate different types of runners.

Figure 8:
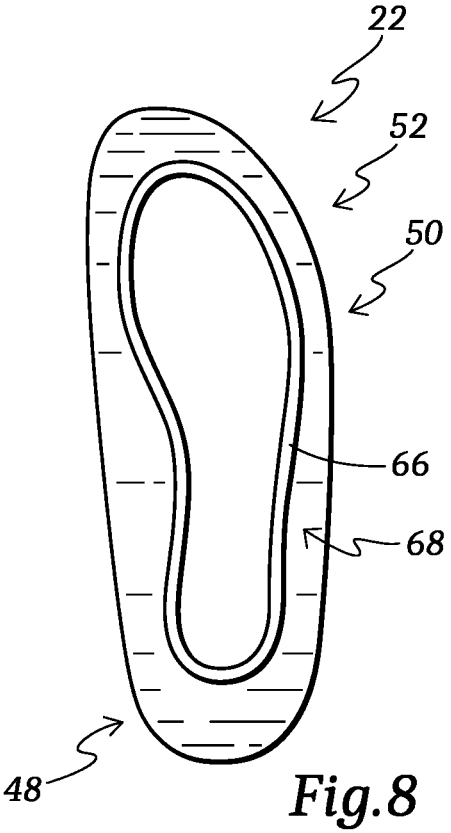
FIG. 8 is a top view of the sole including another embodiment of the support plate.

In FIG. 8, another embodiment of the support plate is shown where the support plate 66 extends from the heel area 48 to the forefoot area 52 of the sole 22 and has a width that is less than the width of the sole. In this embodiment, the body 68 of the support plate 66 is located near the periphery of the sole 22 to focus the support on the periphery of a user's foot during movement while providing cushioning in the central area of their foot. It should be appreciated that the support plate 66 in this embodiment may extend from the heel area 48 to the midfoot area 50 of the sole 22, from the midfoot area 50 to the forefoot area 52 of the sole 22 or extend along any suitable portion of the sole 22 to enhance the movement by a user while reducing the impact stresses on the user's body.

Figure 9:
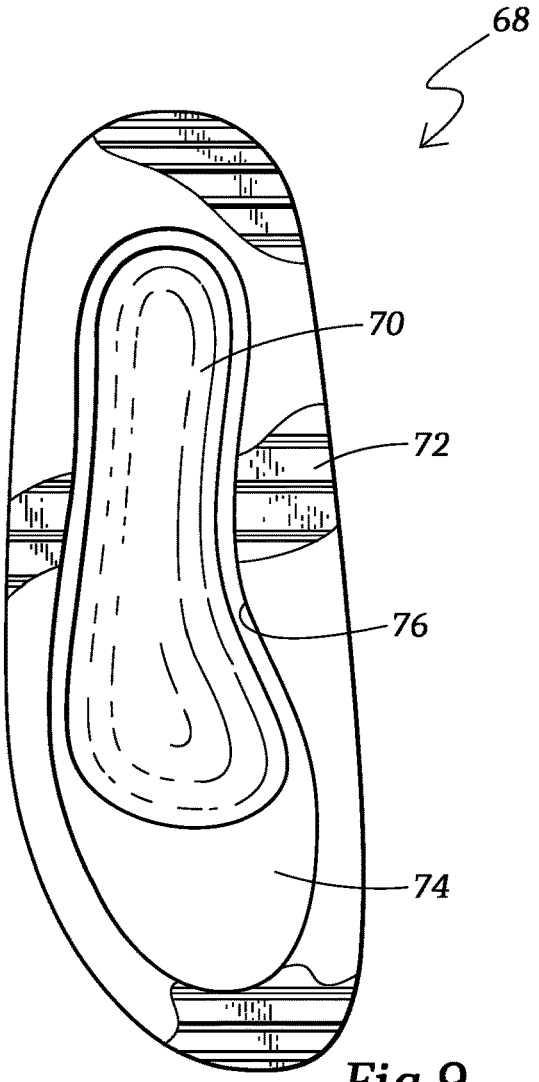
FIG. 9 is another embodiment of the present sole where the outsole includes a through-hole.

Referring to FIG. 9, another embodiment of the present sole is shown where the sole 68 includes a midsole 70 and an outsole 72 attached to the midsole by an adhesive or other suitable attachment method. A support member, such as support plate 74, is placed between the midsole 70 and the outsole 72. In this embodiment, the support plate 74 may be made of a reinforced material, a carbon-fiber reinforced material, a foam material, EVA, thermoplastic polyurethane (TPU), a metal material, a composite material or any suitable material or combination of materials. As shown, the outsole 72 includes a through-hole 76 such that a portion of the midsole 70 and a portion of the support plate 74 are visible from a bottom surface 78 of the outsole 72. The midsole 70, the support plate 74 and the outsole 72 are preferably attached together using an adhesive that also acts as a sealant to prevent dirt and other debris from entering through the bottom surface of the sole. In another embodiment, an adhesive is used to attach the midsole, the support plate and the outsole together and a separate sealant is applied to the bottom surface of the sole. Placing the through-hole 76 in the central area of the outsole 72 as shown in FIG. 9, provides cushioning and grip along the periphery of the sole 68 while lessening the overall weight of the sole. It should be appreciated that the shape and size of the through-hole 76 in the outsole 72 may be adjusted to accommodate different impact forces and balance issues associated with different types of runners and different types of terrain. In another embodiment, the outsole 72 includes a plurality of through-holes to provide additional cushioning in different areas of the sole 68. For example, the outsole 72 may have two or more through-holes in the midfoot area so that the outsole provides additional cushioning in the heel area and forefoot area of the sole.

Figure 10:
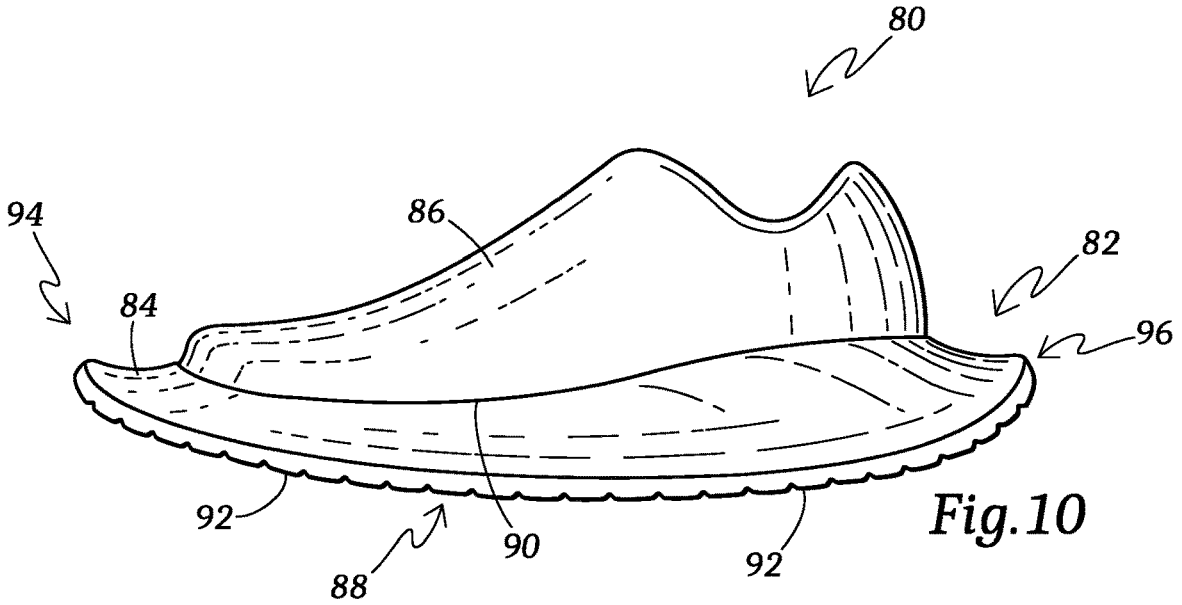
FIG. 10 is a side view of another embodiment of an article of footwear having a sole with a curved bottom surface.
Figure 11:
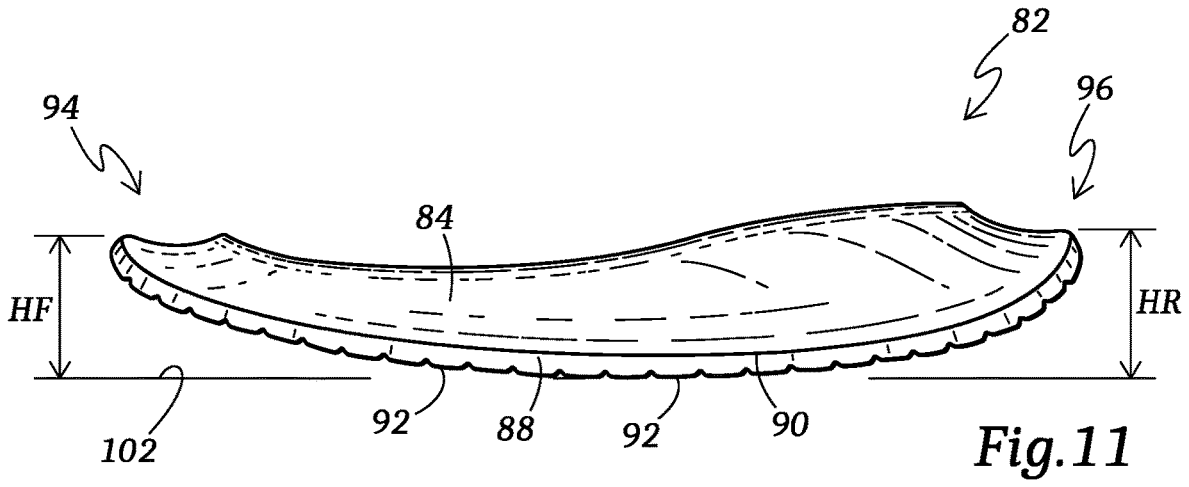
FIG. 11 is a side view of the sole of FIG. 10.

Referring now to FIGS. 10 and 11, in a further embodiment, an article of footwear or shoe 80 includes a sole, generally indicated as 82, having a midsole 84 attached to an upper 86, and an outsole 88. The midsole 84 may be an integral, molded component made of a material having a designated hardness value or made with different materials having the same or different hardness values. For example, one or more portions of the midsole 84 may be made with a material having a hardness or hardness value that is greater than a hardness or hardness value in other areas of the midsole to increase the stability and support or cushioning in designated areas of the midsole. As shown in FIG. 10, the outsole 88 is attached to a bottom surface 90 of the midsole 84 by an adhesive or by molding, and is made of rubber. The outsole 88 typically includes a plurality of tread members 92 that are configured to grip an underlying surface, such as the ground, during movement. It should be appreciated that the midsole 84 and outsole 88 may be made of a foam material, rubber, ethylene vinyl acetate (EVA), thermoplastic polyurethane (TPU), a composite material or any suitable material or combination of materials.

Figure 12:
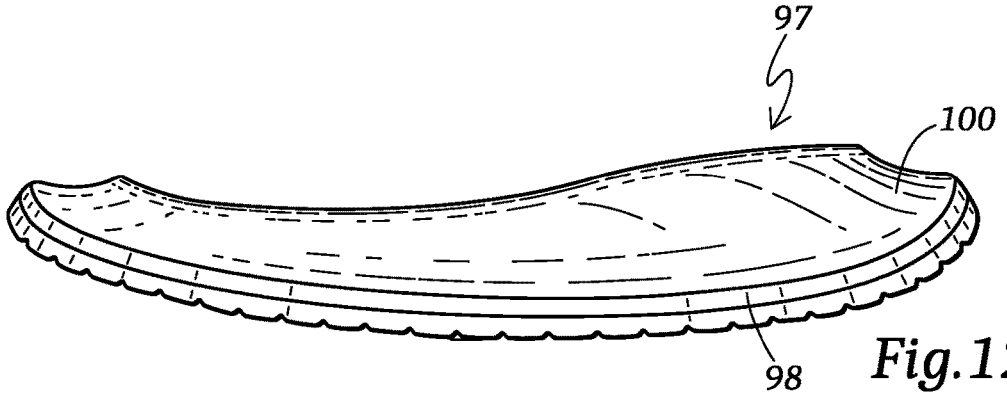
FIG. 12 is a side view of a further embodiment of the sole where the sole includes multiple layers.

In this embodiment, the bottom surface 90 of the midsole 84 is formed with a continuous curvature or curved surface (no flat surfaces) that extends along an entire length of the midsole from the front end 94 to the rear end 96 of the sole. The continuous curved bottom surface 90 of the midsole 84 facilitates the natural rolling motion of a person's foot from the initial impact on the heel, to the midfoot area and then to the forefoot area of a user's foot. In an embodiment, the midsole 84 is made with a material having a uniform hardness value that supports and cushions a user's foot during the rolling motion. In another embodiment shown in FIG. 12, a bottom layer or bottom portion 98 of the midsole 97 is made with a material having a hardness value that is greater than a hardness value of the upper portion 100 of the midsole. The bottom portion 98 and upper portion 100 of the midsole 97 may be made with the same material or different materials. The bottom portion 98 may be an independent portion of layer positioned between the upper portion 100 and the outsole, embedded at least partially in the upper portion 100 or the bottom portion 98 and the upper portion 100 may be molded together. In an example embodiment, the midsole 97 is made entirely with EVA such that the upper portion 100 is made with an EVA having a greater hardness value than the EVA used to make the bottom portion 98 of the midsole 97. It should be appreciated that the midsole may be made with two or more layers or portions based on a desired level of support and cushioning. In another embodiment, the midsole 97 has different hardness values in two or more portions of midsole. In one example embodiment, the hardness value in a toe area of the midsole is greater than a hardness value of other areas of the midsole, which helps push off on the support plate in the toe area by a user's foot thereby enhancing propulsion forward during movement. It should be appreciated that different areas of the midsole may have different hardness values to adjust the support and comfort of the article of footwear.

As shown in FIG. 11, the front end 94 of the sole 82 has a front height (HF) that is the distance between the front end and an underlying surface 102 and the rear end 96 has a rear height (HR) that is the distance between the rear end and the underlying surface 102. The front height (HF) may be less than the rear height (HR) as shown in FIG. 11, the front height (HF) may be greater than the rear height (HR) or the front height (HF) and the rear height (HR) may be the same. In the above embodiments, the front height (HF), the rear height (HR) and the curvature of the bottom surface 90 of the sole 82 may be adjusted to adjust the rolling motion of the shoe to accommodate different gaits, foot impact positions and stability of walkers, joggers and runners.

Figure 13:
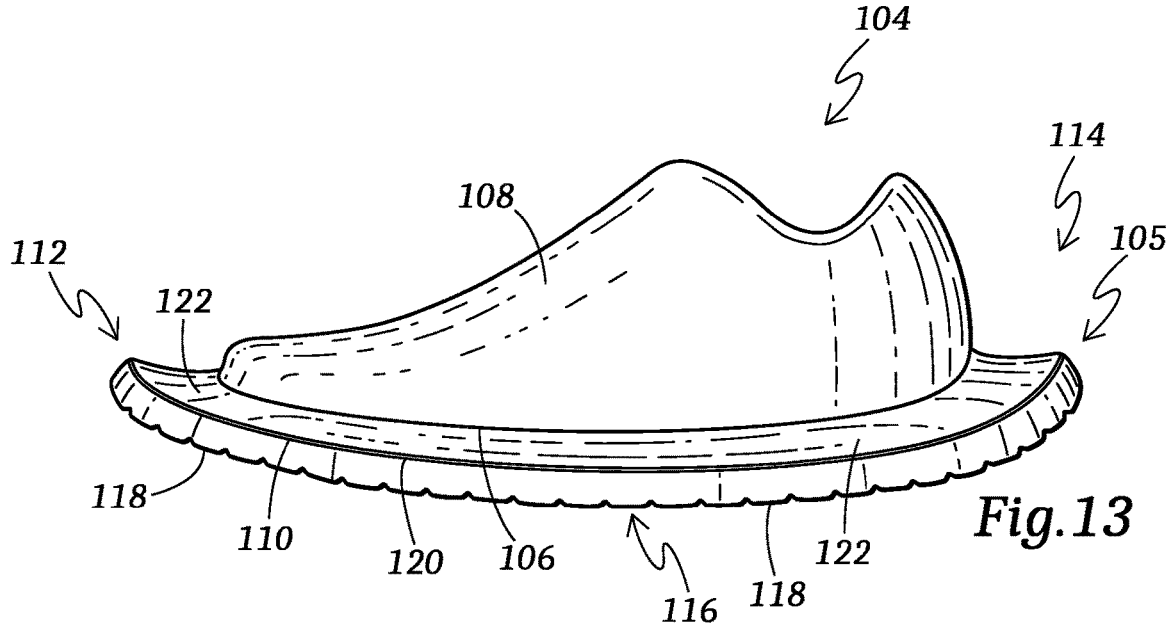
FIG. 13 is a side view of another embodiment of an article of footwear including a support member and portions of a midsole.

Referring to FIG. 13, another embodiment of the sole is shown where the sole 104 has a midsole 105 that is attached to a bottom surface 106 of an upper 108. In this embodiment, the sole 104 includes a support member such as support plate 110, that extends from the front end 112 to the rear end 114 of the sole 104. An outsole 116 including tread members 118 is attached to a bottom surface 120 of the support plate 110 to provide grip on an underlying surface. As shown, the bottom surface 120 support plate 110 has a continuous curvature that facilitates the rolling motion described above. Since the support plate 110 also provides stability and support to a user's foot, portions of the midsole 105 are formed as cushion members 122 and placed in areas of the user's foot that need cushioning such as in the forefoot area and the heel area. In this way, the support plate 110 helps to reduce the amount of cushioning that is needed in the shoe, which in turn, reduces the overall size of the sole 104 and the material needed to make the sole. It is contemplated that the sole 104 may include one cushion member or a plurality of the cushion members 122. In another embodiment, a relatively thin midsole is positioned between the upper and the support plate to provide cushioning along the length of the sole 104.

Figure 14:
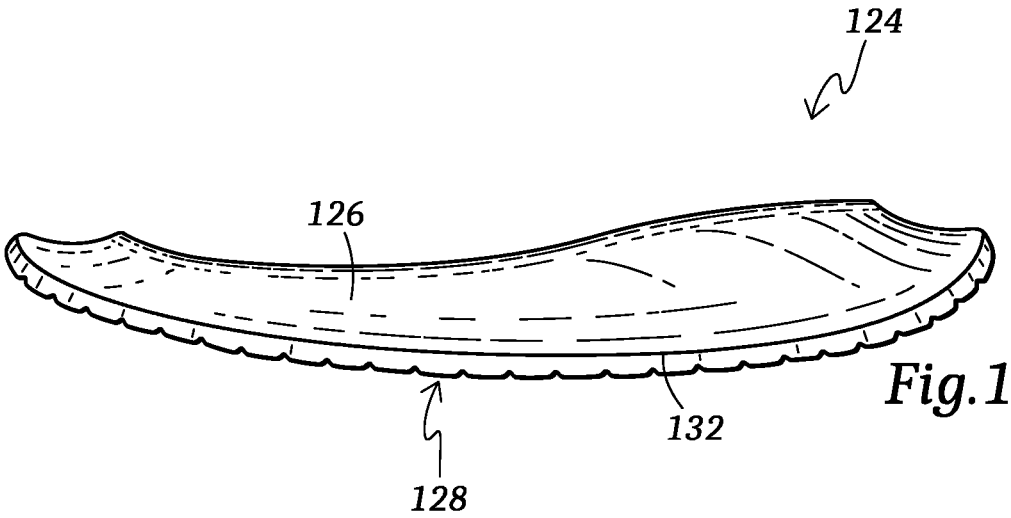
FIG. 14 is another embodiment of the sole including a midsole having medial and lateral portions.
Figure 15:
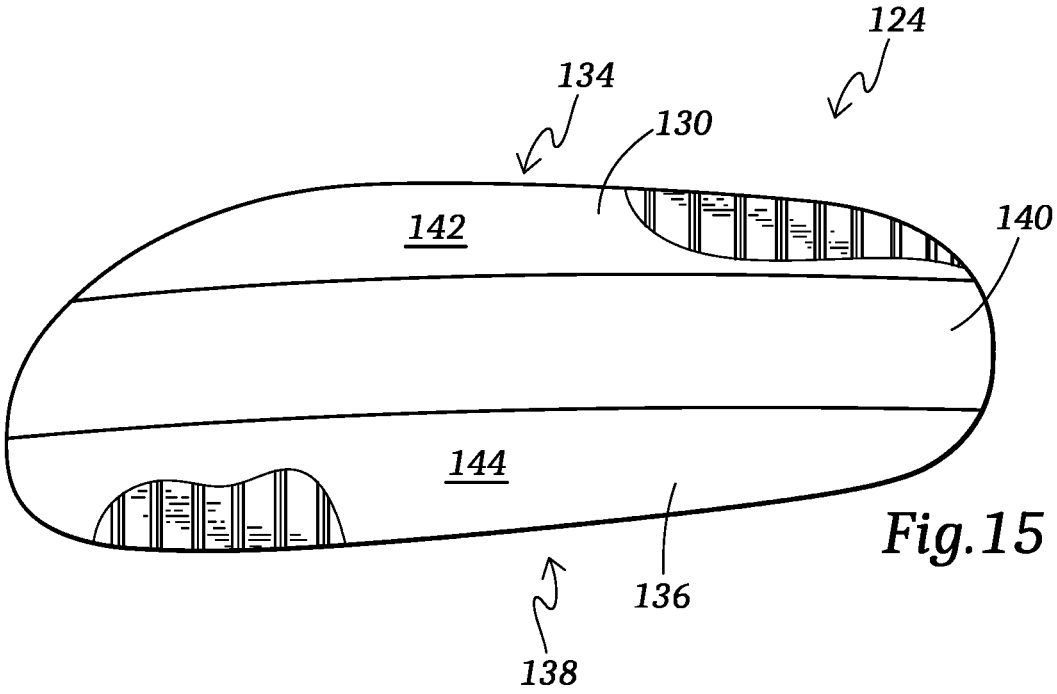
FIG. 15 is a bottom view of the sole of FIG. 14.

Referring to FIGS. 14 and 15, in another embodiment, the sole designated as 124, includes a midsole 126 and an outsole 128 attached to the midsole. The midsole 124 is formed with a medial portion 130 that extends along the bottom surface 132 of the midsole 126 on the medial side 134 of the midsole, and a lateral portion 136 that extends along the bottom surface 132 on the lateral side 138 of the midsole. The middle portion 140 of the midsole 126 between the medial portion 130 and the lateral portion 136 may be a flat surface, a concave surface, a convex surface, or any suitably shaped surface that does not extend beyond the bottom surfaces 142 and 144 of the medial portion 130 and the lateral portion 136 of the midsole 126. In this embodiment, the curvature of the bottom surfaces 142, 144 of the medial portion 130 and the lateral portion 136 may be the same or different depending on the gaits and impact positions of a user's feet. For example, the medial portion 130 may have a curvature and hardness value that is greater than a curvature and hardness value of the lateral portion 136 to accommodate a runner that pronates during running. It should be appreciated that the medial portion 130 and the lateral portion 136 may have any suitable curvature and may have any suitable hardness value.

As described above, the stiffness of the sole, and more specifically, the midsole may be adjusted to adapt to pressure mapping and adjust the weight of the midsole and thereby the weight of the article of footwear. In an embodiment, the midsole may have a 100 index in a rear portion of the midsole, 120 to 140 index in a meta area of the midsole and 200 index in post meta areas of the midsole. In another embodiment, the hardness values of the midsole differ across the midsole where the hardness value in a center area of the midsole is different than a hardness value at one or more side areas of the midsole, such as in a medial side area and a lateral side area of the midsole. Adjusting the stiffness of different areas of the midsole by adjusting the hardness values of the midsole enable the midsole to be tuned to the type of walking or running performed by a user. In an example embodiment, the hardness value of the rear or heel area of the midsole is 100 in a center area and 115 on the sides. Further, in the meta area, the hardness value is 120 on a lateral side and 130 to 140 on the medial side, and in the toe area, the hardness value is 150 in a center area and 200 in the side areas. It should be appreciated that the hardness values, i.e., the stiffness, of the midsole may be any suitable hardness value or hardness values.

While particular embodiments of the present sole are shown and described, it will be appreciated by those skilled in the art that changes and modifications may be made thereto without departing from the invention in its broader aspects and as set forth in the following claims.

What is claimed is:

1. An article of footwear comprising:

an upper;

a sole including a midsole attached to said upper and an outsole, said midsole having a front end and a rear end, wherein an outer surface of said midsole extends continuously outwardly from a top edge of said midsole to a bottom edge of said midsole along an entire perimeter of said midsole; and a support member positioned on a bottom surface of the midsole and on a top surface of said outsole, said support member extending from said rear end to said front end of said midsole, said support member having a bottom surface that is continuously curved from a rear end to a front end of said support member.

2. The article of footwear of claim 1, wherein said support member has a shape and size that is the same as a shape and size of an upper surface of said outsole.

3. The article of footwear of claim 2, wherein said support member has a shape and size that is the same as a shape and size of a bottom surface of said midsole.

4. The article of footwear of claim 1, wherein said support member is a support plate positioned between said midsole and said outsole.

5. The article of footwear of claim 1, wherein said midsole includes a first layer and a second layer.

6. The article of footwear of claim 5, wherein said second layer has a hardness value that is greater than a hardness value of said first layer.

7. The article of footwear of claim 1, wherein said outsole includes at least one through-hole such that a portion of the support member and said midsole are exposed on a bottom surface of said sole.

8. The article of footwear of claim 1, wherein said sole has a rear end and a front end, and a height of said front end of said sole is greater than a height of said rear end of said sole.

9. The article of footwear of claim 1, wherein said sole has a rear end and a front end, and a height of said front end of said sole is equal to a height of said rear end of said sole.

10. The article of footwear of claim 1, wherein said sole has a rear end and a front end, and a height of said front end is less than a height of said rear end.

11. The article of footwear of claim 1, wherein the midsole includes different areas, and at least two of the areas have different hardness values.

12. The article of footwear of claim 1, wherein a height of a front point of said support member relative to a bottommost point of the outsole is less than a height of a rear point of said support member relative to the bottommost point of the outsole when the article of footwear is not in use.

13. The article of footwear of claim 1, wherein a portion of the outer surface of said midsole has a concave curvature.

14. An article of footwear comprising:

an upper;

a sole including a midsole attached to said upper and an outsole, said midsole and said outsole each including a front end and a rear end, wherein an outer surface of said midsole extends outwardly from a top edge of said midsole to a bottom edge of said midsole along an entire perimeter of said midsole, wherein an entirety of said outer surface has a continuous curvature from said top edge to said bottom edge of said midsole; and a support plate positioned between the midsole and the outsole, said support plate extending from said rear end to said front end of said midsole and said outsole, said support plate including a bottom surface, wherein said bottom surface of said support plate and said outsole are each continuously curved from a rear end to a front end of said support plate.

15. The article of footwear of claim 14, wherein said support plate has a shape and size that is the same as a shape and size of an upper surface of said outsole.

16. The article of footwear of claim 14, wherein said support plate has a shape and size that is the same as a shape and size of a bottom surface of said midsole.

17. The article of footwear of claim 14, wherein said sole has a rear end and a front end, and a height of said front end of said sole is greater than a height of said rear end of said sole.

18. The article of footwear of claim 14, wherein said sole has a rear end and a front end, and a height of said front end of said sole is equal to a height of said rear end of said sole.

19. The article of footwear of claim 14, wherein said sole has a rear end and a front end, and a height of said front end is less than a height of said rear end.

20. The article of footwear of claim 14, wherein a portion of the outer surface of said midsole has a concave curvature.

* * * * *